US006174035B1

(12) United States Patent
Flannery et al.

(10) Patent No.: US 6,174,035 B1
(45) Date of Patent: Jan. 16, 2001

(54) REFRIGERATOR CABINET WITH ENHANCED ACCESS ZONE

(75) Inventors: John P. Flannery, Smiths (BM); Timothy C. Noke, Mountain View, CA (US); Sergio M. Photiadis, Athens (GR); Christopher Raia, Brookline, MA (US); Michael T. Lye, Warwick, RI (US); George G. Brin, Jr., Providence, RI (US); Marc S. Harrison, deceased, late of Portmouth, RI (US), by Diana Harrison, executrix

(73) Assignee: Maytag Corporation, Newton, IA (US)

( * ) Notice: Under 35 U.S.C. 154(b), the term of this patent shall be extended for 0 days.

(21) Appl. No.: 09/440,123

(22) Filed: Nov. 15, 1999

(51) Int. Cl.[7] ..... A47B 96/04
(52) U.S. Cl. ..... 312/405; 312/283
(58) Field of Search ..... 312/405, 283, 312/286, 321.5, 326, 325, 329

(56) References Cited

U.S. PATENT DOCUMENTS

D. 86,878 * 5/1932 Dohner ..... 312/329
778,390 * 12/1904 Wheeler ..... 312/283
1,026,264 * 5/1912 Hokanson ..... 312/283
2,347,985 5/1944 Beersman .
2,480,004 8/1949 Reeves .
2,728,624 12/1955 Caruso .
3,133,427 5/1964 Petkwitz .
5,147,122 9/1992 Short .
5,661,914 9/1997 Millet .

* cited by examiner

*Primary Examiner*—Peter M. Cuomo
*Assistant Examiner*—Jerry Anderson
(74) *Attorney, Agent, or Firm*—Everett G. Diederiks, Jr.

(57) ABSTRACT

A refrigerator cabinet includes a shell within which is defined at least one food compartment. For enhancing the access to the food storage compartment, the shell is provided with an open frontal zone which includes a frontal facing portion and a sideward facing portion. A door is hingedly connected adjacent one side of the cabinet, extends across the front of the cabinet and wraps around to an opposing side of the cabinet. In this fashion, a section of the door actually defines an extension of one side of the refrigerator cabinet such that, when the door is opened, enhanced access to within the refrigerator is provided.

11 Claims, 2 Drawing Sheets

REFRIGERATOR CABINET WITH ENHANCED ACCESS ZONE

BACKGROUND OF THE INVENTION

1. Field of the Invention

The present invention pertains to the art of refrigerators and, more particularly, to a refrigerator cabinet having an enlarged open frontal zone in order to enhance access to within a compartment of the refrigerator cabinet.

2. Discussion of the Prior Art

Various different types of refrigerators are available on the market today. For example, a common type of refrigerator is generally referred to as a top mount style which incorporates an upper freezer compartment separated from a lower fresh food compartment by a mullion area. Each of the compartments in a top mount refrigerator can be accessed by pivoting a door which is hinged about a generally vertical axis at one side edge portion of a cabinet of the refrigerator. The cabinet of the refrigerator includes side panels which have substantially equal fore-toaft associated dimensions such that the open frontal zone associated with each of the compartments of the refrigerator generally extends in a single vertical plane. In order to seal the opening, the associated door is generally constituted by a planar member.

Although such a conventional refrigerator arrangement is considered to provide ample access to within the respective compartments in order to store or retrieve food items chilled with the refrigerator, there is still a need in the art for a refrigerator which includes an enlarged open frontal zone in order to enhance the accessibility of food items stored in the refrigerator.

SUMMARY OF THE INVENTION

A refrigerator cabinet assembly constructed in accordance with the present invention includes a cabinet shell having first and second laterally spaced side panels, a top panel interconnecting upper end portions of the side panels and an open frontal zone permitting access to within a food storage compartment defined within the cabinet shell. The side panels of the cabinet shell have different associated depth dimensions such that the open zone includes a frontal facing portion and a sideward facing portion. A door includes a first frontal edge portion which is hingedly connected adjacent one of the side panels and a second frontal edge portion which leads to a side edge portion of the door. The side edge portion wraps around the front of the refrigerator and generally defines an extension of the second side panel.

With this configuration, the open frontal zone of the refrigerator is enlarged as compared to more conventional refrigerators such that enhanced access to within the food storage compartment is provided. More specifically, the side edge portion of the door is angled with respect to a front surface thereof such that when the door is opened, the size of the access opening created into the food storage compartment is larger than an opening which would be created when pivoting a conventional refrigerator door through a corresponding angle.

Additional objects, features and advantages of the present invention will become more readily apparent from the following detailed description of the preferred embodiments thereof when taken in conjunction with the drawings wherein like reference numerals refer to corresponding parts in the several views.

DETAILED DESCRIPTION OF THE PREFERRED EMBODIMENTS

Figure 2:
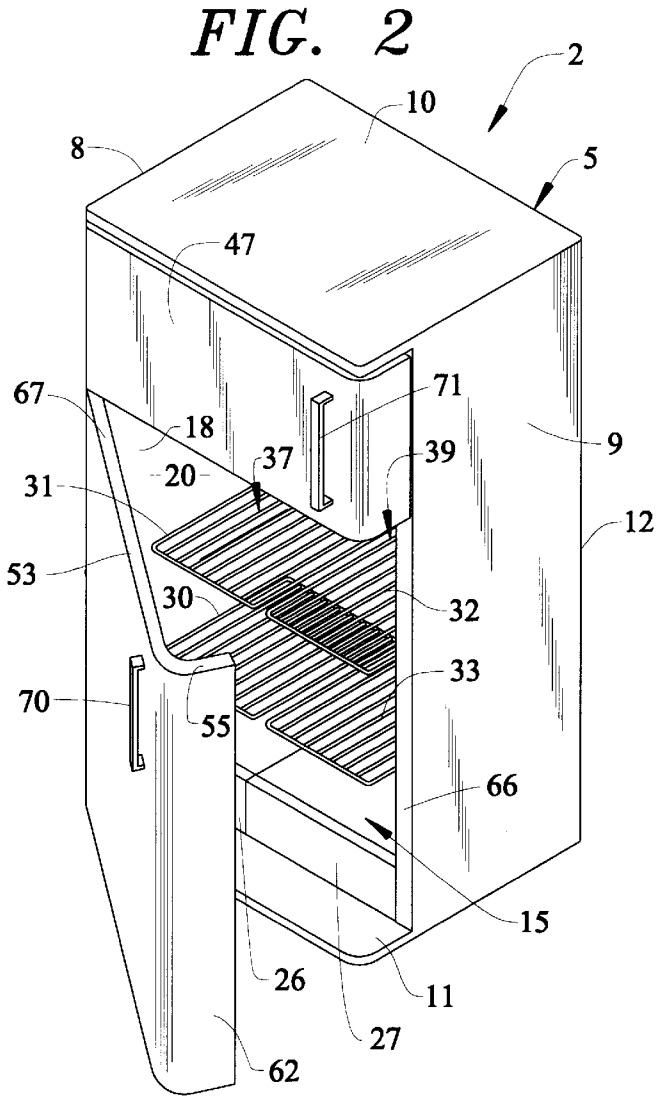
FIG. 2 is a perspective view similar to that shown in FIG. 1, but with the refrigerator shown in a partially opened condition.
Figure 1:
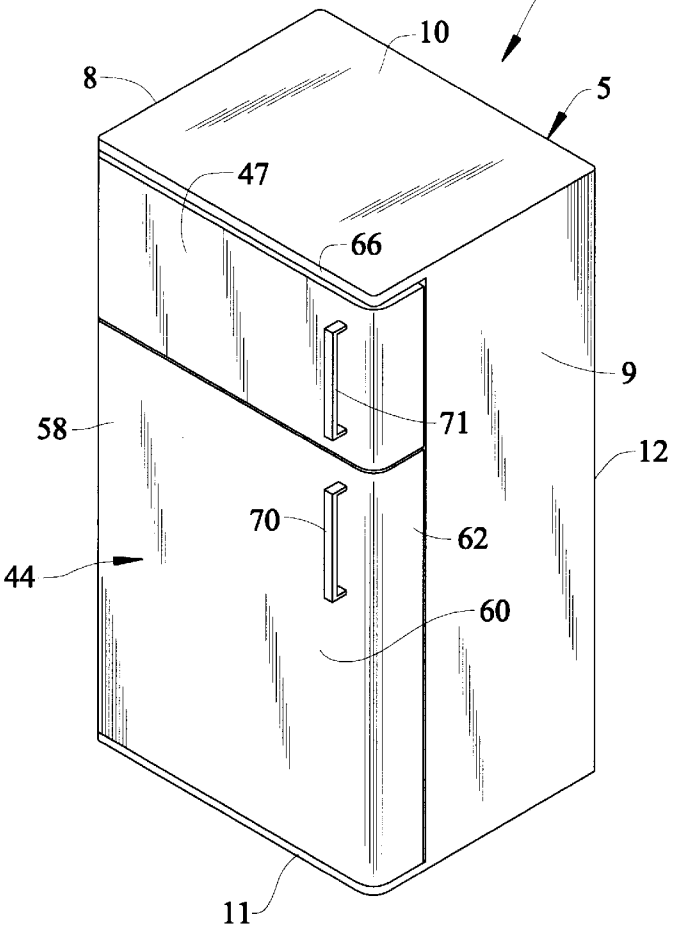
FIG. 1 is a upper right perspective view of a top-mount style refrigerator incorporating the enhanced access opening arrangement of the present invention, with doors of the refrigerator being shown in a closed condition.

Reference will be initially made to FIGS. 1 and 2 in describing a refrigerator cabinet 2 constructed in accordance with a first preferred embodiment of the invention. Refrigerator cabinet 2 is shown to include a cabinet shell 5 that is generally formed from side panels 8 and 9, a top panel 10, a bottom panel 11 and a rear panel 12. At this point, it should be initially recognized that shell 5 can be constructed in various fashions, including providing separate panels 8–12 which are attached together or forming various panels, such as side panels 8 and 9 and top panel 10, from a single piece of material and attaching thereto bottom panel 11 and rear panel 12. In any case, refrigerator cabinet 2 is provided with an open frontal zone 15 which exposes a liner 18 that defines a food storage compartment 20.

In the embodiment shown, food storage compartment 20 defines a fresh food compartment and arranged thereabove is a freezer compartment (not labeled). Therefore, refrigerator cabinet 2 generally takes the form of a top mount style refrigerator generally known in the art. For the sake of completeness, food storage compartment 20 is illustrated to include a pair of laterally spaced, lower, slidably mounted bins 26 and 27, as well as a plurality of shelves 30–33. In general, the number of compartments within refrigerator cabinet 2 or the interior arrangement thereof is not pertinent to the present invention. However, what is important to note is that open frontal zone 15 includes a frontal facing portion 37 and a sideward facing portion 39. More particularly, you will note that side panel 8 has a depth dimension which is greater then an associated depth dimension of side panel 9. Therefore, instead of open frontal zone 15 simply extending in a substantially vertical plane at the front of refrigerator cabinet 2, open frontal zone 15 also extends into the side of refrigerator cabinet 2 so as to define sideward facing portion 39.

In the most preferred form of the invention, this configuration for open frontal zone 15 is utilized for both the lower fresh food storage compartment 20 and the upper freezer compartment as clearly shown in these figures. Refrigerator cabinet 2 also includes a door 44 for selectively providing access to and closing off fresh food storage compartment 20, as well as a freezer door 47 for performing the same function in connection with the freezer compartment. In order for door 44 to close off open frontal zone 15 and seal food storage compartment 20, door 44 must extend across both the frontal facing portion 37 and the sideward facing portion 39 such that door 44 must wrap around to side panel 9. In the embodiment shown in FIGS. 1 and 2, door 44 is generally L-shaped so as to include a first leg 53 adapted to extend across frontal facing portion 37 and a second leg 55, which is angled relative to first leg 53 and which is adapted to extend across sideward facing portion 39 of open zone 15. More specifically, door 44 includes a first, vertically extending frontal edge portion 58 that is hinged about a generally vertical axis to shell 5. Door 44 also includes a second frontal edge portion 60 that curves so as to lead to a side edge portion 62. Side edge portion 62 generally constitutes an extension of side panel 9 as perhaps best shown in FIG. 1.

In this embodiment, door 44 preferably has a substantially uniform thickness from first frontal edge portion 58 to second frontal edge portion 60 and side edge portion 62 as clearly represented in FIG. 2. Side edge portion 62 extends along side panel 9 such that the combined depth of side panel 9 and side edge portion 62 generally equals the corresponding depth of side panel 8, along with the thickness of door 44 at first frontal edge portion 58. When closed, door 44 would be sealed to bottom panel 11, a front facing edge 66 of side panel 9, either to a mullion section or the bottom of freezer door 47 across a top of door 44 and adjacent side panel 8 in order to contain the refrigerated air developed within refrigerator cabinet 2. As also shown in this embodiment, top panel 10 extends over freezer door 47 to provide a sealing surface. Fresh food door 44 is provided with a handle 70 and a similar handle 71 is provided for freezer door 47.

With this construction of refrigerator cabinet 2, enhanced access to within fresh food compartment 20 or the freezer compartment is provided. For instance, due to the fact that open zone 15 includes not only frontal facing portion 37 but also sideward facing portion 39, the opening of door 44 provides a larger access zone to food storage compartment 20 than would otherwise be accorded if sideward facing portion 39 of open zone 15 were not provided. In any event, an enlarged open frontal zone is created to enhance both the storage and removal of food items.

Figure 3:
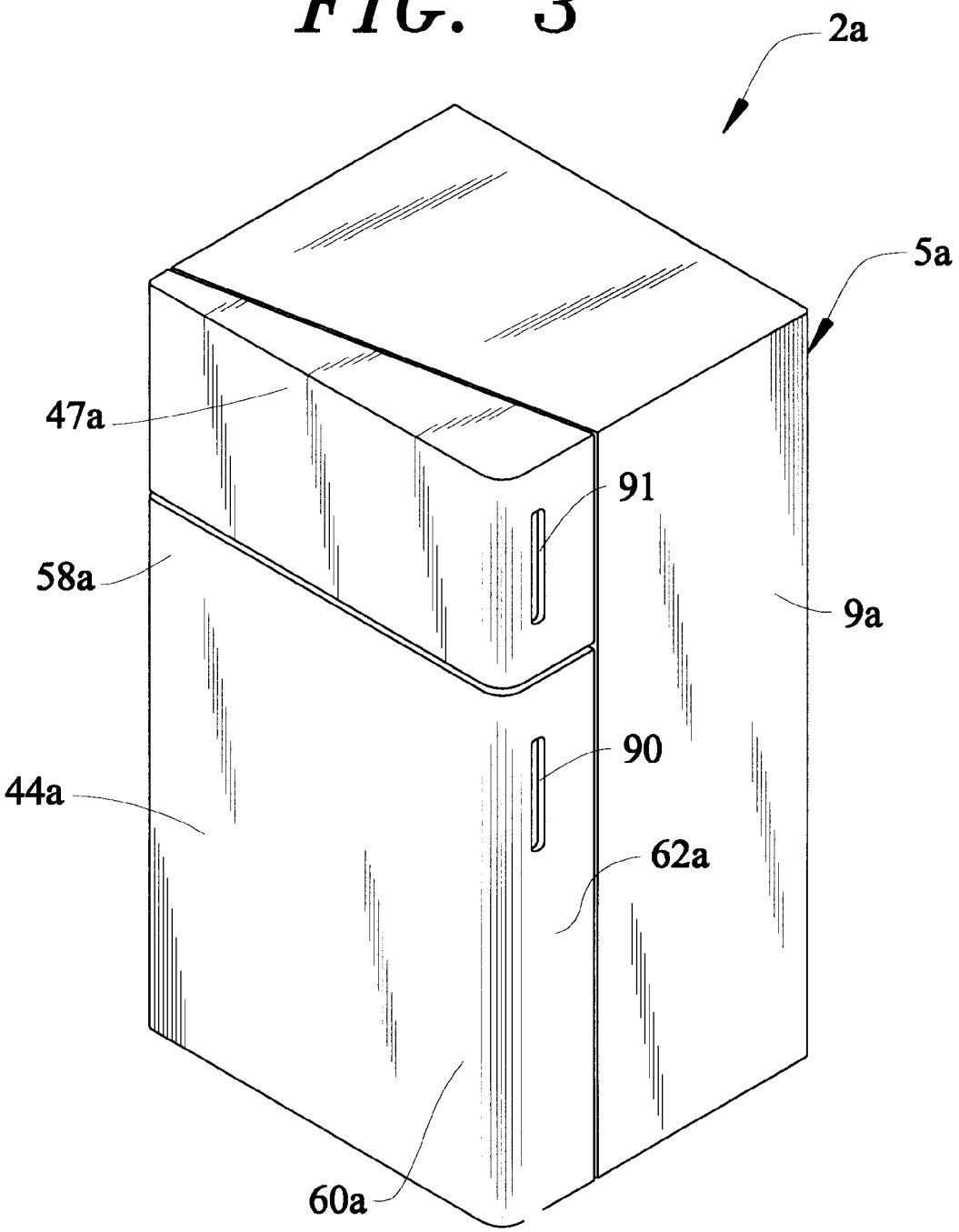
FIG. 3 is an upper right perspective view of a refrigerator cabinet constructed in accordance with a second preferred embodiment of the invention.

FIG. 3 shows a slightly modified embodiment including doors 44*a* and 47*a* which have a variable depth or thickness as clearly shown in this figure. More specifically, each of doors 44*a* and 47*a* includes a first frontal edge portion 58*a* that is hinged about a vertical axis, such as through a conventional upper, lower and central hinge pin arrangement (not shown). With this embodiment, it is important to note that the seal arrangement for each of doors 44*a* and 47*a* is against the shell 5*a*, with each door 44*a*, 47*a* extending in a substantially diagonal manner from a respective first frontal edge portion 58*a* to a side edge portion 62*a*. Therefore, this configuration for doors 44*a* and 47*a* enables the same function of enlarging an access opening for a refrigerator compartment to be accomplished by having portions of the doors 44*a* and 47*a* wrap around side 9*a* of refrigerator cabinet 2*a*. This embodiment also illustrates that different types of handle arrangements can be utilized and the handles can be located in different portions of the doors. More specifically, note the presence of handle 90 provided in fresh food compartment door 44*a* and handle 91 provided in freezer door 47*a*. Handles 90 and 91 in this embodiment are generally created by forming recesses within the respective side edge portions 62*a* of doors 44*a* and 47*a*.

Although described with respect to the preferred embodiments of the invention, it should be readily understood that various changes and/or modifications can be made to the invention without departing from the spirit thereof. For instance, although refrigerator cabinets 2 and 2*a* are illustrated to be self-standing, the invention is equally applicable to other refrigerator arrangements, such as a refrigerator supported upon a countertop. In addition, although the illustrated embodiments generally depict substantially 90° angles between the respective front and side edge portions 60, 62 and 60*a*, 62*a*, an acute angle, such as 45°, could be employed. Such an angling arrangement could, for example, advantageously provide an enlarged countertop area in the alternative embodiment described above. In any event, the invention is only intended to be limited by the scope of the following claims.

We claim:

1. A refrigerator cabinet assembly comprising:

a cabinet shell including first and second laterally spaced side panels, a top panel interconnecting upper end portions of the side panels, and an open frontal zone permitting access to within a food storage compartment defined within the cabinet shell, said open zone including a frontal facing portion and a sideward facing portion;

a liner located within the cabinet shell and defining the food storage compartment;

a plurality of shelves arranged within the food storage compartment, wherein the shelves are adapted to support food items in a below ambient temperature environment within the food storage compartment; and a door including a first frontal edge portion, hingedly connected directly adjacent both the first side panel and the frontal facing portion, and a second frontal edge portion leading to a side edge portion of the door, said door being generally L-shaped including a first leg, defined between the first and second frontal edge portions, and a second leg, which is shorter than the first leg, defined between the second frontal edge portion and the side edge portion, said door being movable between an open position wherein clear access is provided into the food storage compartment and a closed position wherein the door is sealed across the frontal facing portion and wraps around to the sideward facing portion.

2. The refrigerator cabinet assembly according to claim 1, wherein the door is hingedly connected to the cabinet shell about a substantially vertical axis directly adjacent the first side panel.

3. The refrigerator cabinet assembly according to claim 1, wherein the door further comprises a handle provided at the side edge portion.

4. The refrigerator cabinet assembly according to claim 1, wherein said door has an associated depth dimension which is substantially constant from the first frontal edge portion to the second frontal edge portion.

5. The refrigerator cabinet assembly according to claim 1, wherein said door has an associated depth dimension which varies from the first frontal edge portion to the second frontal edge portion.

6. The refrigerator cabinet assembly according to claim 5, wherein the door angles from the first frontal edge portion to the side edge portion.

7. The refrigerator cabinet assembly according to claim 1, wherein the food storage compartment constitutes a fresh food compartment and the refrigerator cabinet assembly further includes a freezer compartment disposed in a vertical relationship with the fresh food compartment, with said freezer compartment having an associated freezer door also including first and second frontal edge portions and a side edge portion.

8. The refrigerator cabinet assembly according to claim 1, wherein the door further includes a handle provided at the second frontal edge portion.

9. The refrigerator cabinet assembly comprising:

a cabinet shell including first and second laterally spaced side panels, a top panel interconnecting upper end portions of the side panels and an open frontal zone permitting access to within a food storage compartment defined within the cabinet shell, said first side panel having an associated depth dimension which is greater then a corresponding depth dimension of the second side panel such that the open frontal zone includes a frontal facing portion and a sideward facing portion;

a liner located within the cabinet shell and defining the food storage compartment;

a plurality of shelves arranged within the food storage compartment, wherein the shelves are adapted to support food items in a below ambient temperature environment within the food storage compartment; and a door movable between an open position wherein clear access is provided into the food storage compartment and a closed position wherein the door is sealed across the open frontal zone, said door including a first leg portion and a second leg portion which is shorter than and located at an angle to the first leg portion such that the door is generally L-shaped, said first leg portion including a first frontal edge portion hingedly connected directly adjacent both the first side panel and the frontal facing portion, said first leg portion further including a second frontal edge portion leading to a side edge portion defined by the second leg portion, wherein the first frontal edge portion has an associated depth dimension which is smaller than a depth dimension of the side edge portion.

10. A refrigerator cabinet assembly according to claim 9, wherein the door has an associated thickness which is substantially constant across the door.

11. A refrigerator cabinet assembly according to claim 9, wherein the door has an associated thickness which various across the door.

* * * * *